US006017069A

United States Patent [19]

Imms et al.

[11] Patent Number: 6,017,069

[45] Date of Patent: Jan. 25, 2000

[54] BAG HOLDER

[76] Inventors: John Victor Imms, 48 Sonning Avenue, Litherland, Liverpool L21 9JY; Joseph Clarke, 245 Lord Street, Southport, Merseyside PR8 1NY, both of United Kingdom

[21] Appl. No.: 09/169,586

[22] Filed: Oct. 9, 1998

[30] Foreign Application Priority Data

Oct. 10, 1997 [GB] United Kingdom ..... 9721409

[51] Int. Cl.[7] ..... B65B 67/04

[52] U.S. Cl. ..... 294/1.1; 248/101

[58] Field of Search ..... 294/1.1, 1.3–1.5, 294/55; 248/95, 99, 101; 15/257.1, 257.3

[56] References Cited

U.S. PATENT DOCUMENTS

| | | | |
|---|---|---|---|
| 3,697,030 | 10/1972 | Schultz | 294/1.1 |
| 3,733,099 | 5/1973 | Szita | 294/1.4 |
| 3,866,872 | 2/1975 | Burgess | 248/101 |
| 3,916,962 | 11/1975 | Stolt | 141/108 |
| 3,998,415 | 12/1976 | D'Antonio et al. | 294/1.1 |
| 4,021,994 | 5/1977 | Mainprice | 53/390 |
| 4,270,788 | 6/1981 | Overholt | 294/55 |
| 4,457,549 | 7/1984 | Lowery | 294/1.4 |
| 4,548,372 | 10/1985 | Lutzker | 248/99 |
| 4,759,519 | 7/1988 | Cheng | 248/99 |
| 5,261,553 | 11/1993 | Mueller et al. | 248/101 |
| 5,308,027 | 5/1994 | Fullilove | 248/101 |

FOREIGN PATENT DOCUMENTS 1374903 11/1974 United Kingdom .

*Primary Examiner*—Dean J. Kramer
*Attorney, Agent, or Firm*—Webb Ziesenheim Logsdon Orkin & Hanson, P.C.

[57] ABSTRACT

A hand held bag holder (10) for maintaining the mouth of a bag in an open position typically for use in collecting garden debris. The bag holder (10) comprises a circular frame (12) and a plurality of clips (16) which are generally U-shaped and secured on the frame (12) in a snap fit arrangement. In use, the upper edge of a bag is folded over the circular frame (12) and held in position by the clips (16).

11 Claims, 1 Drawing Sheet

BAG HOLDER

BACKGROUND OF THE INVENTION

1. Field of the Invention

This invention relates to a bag holder and, in particular, to a hand held holder for supporting a mouth of a bag in an open position.

2. Description of the Prior Art

Hand held bag holders are well-known and find typical application for collecting garden debris. The bag holder supports a mouth of a bag in an open position and can be held single handed whilst the other hand is used to, for example, brush debris into the open bag.

Typical examples of the construction of such prior art bag holders are described in GB 2210847A (Steed), U.S. Pat. No. 3,942,832 (Haas), U.S. Pat. No. 5,193,770 (Kildare) and the applicant's co-pending application No. GB 2308346A. GB 2210847A (Steed) describes a hand held bag or sack holder comprising a hoop having a radially outwardly extending flange and a resilient ring which extends around the hoop and, in use, clamps a portion of a mouth of a bag folded over the hoop against an outwardly facing surface of the hoop at a position below the flange. U.S. Pat. No. 3,942,832 (Haas) discloses a bag holder comprising a rim in the form of a loop having an outwardly facing circumferential groove formed therein. In use, an open end of a bag is folded over the rim and an elastic cord is wrapped around the loop and positioned in said groove thereby retaining the bag. U.S. Pat. No. 5,193,770 (Kildare) describes a bag holder comprising an annular frame with an outer peripheral groove therein for receiving a split ring having a handle formed at each of its free ends. In use, an open end of a bag is folded over the frame and retained in said groove by the split ring with its handles being brought and locked together. GB 2308341A describes a bag support comprising a circular band and a member for clamping an upper portion of the body to an outer face of the band.

Hence, the above documents describe hand held bag holders which are of similar construction ie a frame, usually in the form of a circular band, and a single clamping member which extends circumferentially around an outer face of the frame.

The bag holders of the above prior art documents are of relatively complicated construction and therefore relatively expensive to manufacture.

An aim of the present invention is to provide a hand held bag holder of relatively simple construction.

SUMMARY OF THE INVENTION

In accordance with the present invention, there is provided a hand held bag holder comprising a member forming a frame defining a mouth and at least one clip comprising two or more spaced locating limbs which, in use, at least partially envelops the circumference of a cross section of the member for securing an open end of a bag to the frame such that a mouth of the bag is supported in an open position.

Preferably, in use, an upper part of a bag is folded over a top side of the frame and the clip installed such that a portion of the bag is held, clamped or gripped at least partially around said circumference.

It is preferred that the clip comprises a base and two spaced apart limbs which are preferably in the form of legs, extending away from said base and defining an open mouth therebetween. The clip may be provided by a generally U-shaped channel. In use, the legs straddle the frame member and clamp portions of a bag against sides of said circumference which may be directly opposing. The legs may, in use, substantially envelop the circumference of a cross section of the member. Hence, a clip may, in use, clamp a portion of a bag around a substantial portion of said circumference and consequently may provide a greater securement of a bag to a frame than is provided by the above described prior art bag holders which only clamp a bag to a single face of a frame.

The frame is preferably annular and, more preferably, the mouth defined thereby is circular.

The clip may be installed on said frame member in any direction. The frame lies in a plane and the direction of installation of the clip may be in a direction which is in said plane or in a plane parallel thereto. For example, in the embodiment wherein the mouth defined by the frame is circular, the clip may be installed in a radial direction and preferably in an inwardly directed radial direction. The direction of installation may be substantially perpendicular to the plane of said frame and, more preferably, in a direction from said top side of the frame member to the opposing side.

The clip may be adapted for snap fit engagement with the frame. For example, the frame may be provided with a circumferential groove and at least one of said legs of the clip may engage therewith. A circumferential groove may be provided in an inner and outer face of the frame and said legs may engage therewith to provide said snap fit engagement.

The width of the open mouth of a clip may be narrower than the maximum diameter of a cross section of said member. A clip may be resilient and allow for distortion thereof to enable the fitment around the maximum diameter of said cross section thereby providing said snap fit arrangement.

There may be provided a single clip for securing a bag to the frame and said clip may be of substantially the same circumferential length as the circumference of the frame. Hence, the clip secures a bag to the frame around substantially the whole of the circumference of the frame.

An elongate clip may be curved along its longitudinal length and have a curved longitudinal axis. The curvature of the open mouth of the clip may match the curvature of said axis and the legs of said clip may be curved so as to match the circumferential curvature of the frame. Alternatively, the legs of the clip may lie in substantially parallel planes with the base of the clip preferably curved so as to match the circumferential curvature of the frame.

With the clip curved such that the longitudinal axis and the mouth are correspondingly curved, the clip is installed in a direction which is perpendicular to the plane of the mouth defined by the frame ie the installation of the clip is in a direction which is substantially perpendicular to a single plane in which said axis lies in. In the case of the clip having its legs lying substantially in parallel planes, the clip is installed in a direction which is in the plane of the frame or in a plane parallel thereto eg. radially inward, ie the installation of the clip is in a direction which is in the plane in which the longitudinal axis lies in or in a plane parallel thereto.

The frame member may be of any convenient shape in cross section. rectangular, square or hexagonal, but is preferably circular.

It is preferred that a plurality of clips are provided and that, in use, they secure a bag to the frame at spaced apart positions around the circumference thereof. Said positions may be uniformly spaced apart.

The frame may have predefined spaced apart locations at which said clips co-operate with the frame. The predefined locations may be provided by sections of the frame having reduced cross-sectional areas. Said sections may be of equal circumferential length and are preferably spaced apart at equidistant intervals around the circumference of the frame. In this manner such sections serve as locators for the clips and hence simplify the operation of fitting the clips in the optimum positions ie. uniformly spaced apart. The distance of separation between adjacent sections is preferably greater than the length of one of said sections. Preferably, the length of said clips is substantially the same but less than the length of said sections.

A clip may be substantially circular in cross section and may be in the shape of a split ring. The free ends of a clip may extend outwards to provide finger purchase to ease removal of the clip from the section.

The frame and handle may be formed separately and secured together by suitable means. Alternatively, and in a preferred embodiment, the frame and handle are formed in one piece. The frame, handle and clips may be formed of a plastics material.

An embodiment of the present invention will now be described, by way of example only, with reference to the accompanying drawings, wherein

DETAILED DESCRIPTION OF THE PREFERRED EMBODIMENTS

Figure 1:
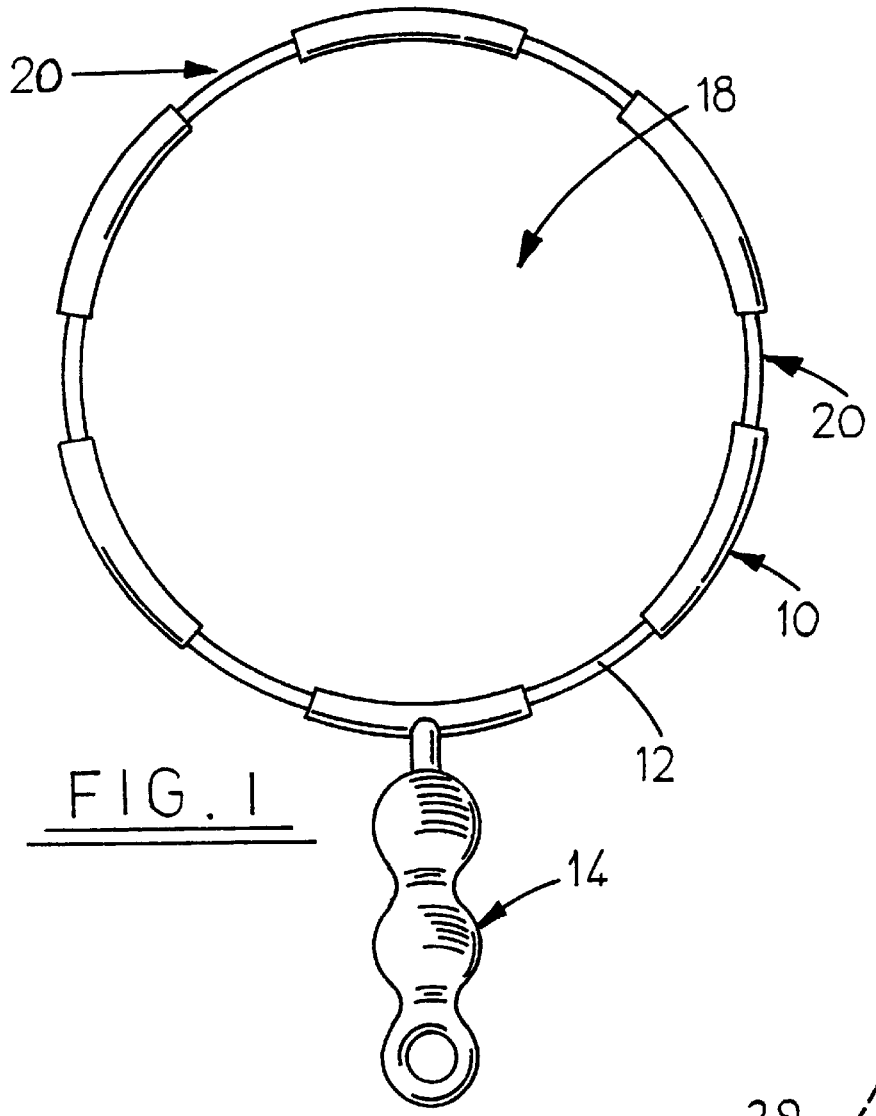
FIG. 1 is a plan view of a frame and handle of a hand held bag holder according to an embodiment of the present invention.

With reference to the accompanying drawings, a hand held bag holder is illustrated and indicated generally by numeral 10. The bag holder 10 comprises a ring 12 having a handle 14 extending therefrom and six identical clips 16 although only one is illustrated. The ring and handle are formed in one piece in a plastics material. Also, the clips are formed in a plastics material and are resiliently deformable.

Ring 12 defines a circular mouth 18 and is itself circular in cross-section. The ring has six uniformly spaced apart sections 20 of reduced diameter. The sections are of equal length which is approximately half the length of an intervening portion of the ring between adjacent sections. Handle 14 extends radially outwardly from a portion of the ring between two adjacent sections.

A curved elongate clip 16 comprises a base 22 and spaced apart legs 24,26 extending therefrom. In cross section, the clip is in the form of a split ring defining a mouth 28 and which lies in a single plane between the ends of the legs. The free ends of the split ring ie. ends of legs 24,26, curve outwardly from said mouth and width of said mouth 28 is less than the diameter of the ring at said sections.

The clip has a curved longitudinal axis 29 and said mouth is correspondingly curved. The length of the clip is substantially the same although slightly less than the length of a section 20. The legs are curved longitudinally to match the curvature of the sections. The clip defines a ring receiving part 30 which is substantially in the form of a cylindrical hollow, the diameter of which is substantially the same diameter as that of the ring at said sections.

Figure 3:
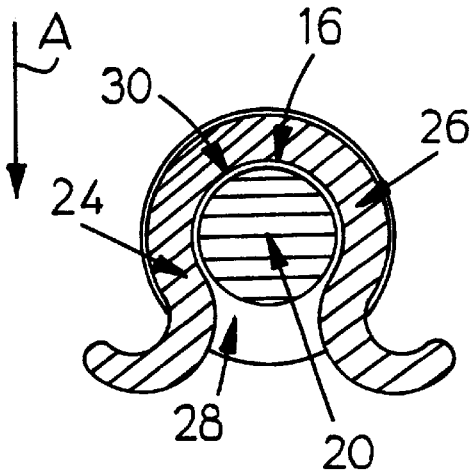
FIG. 3 is a sectional view of the clip shown in FIG. 2 attached to a smaller diameter section of the frame of the bag holder shown in FIG. 1.
Figure 2:
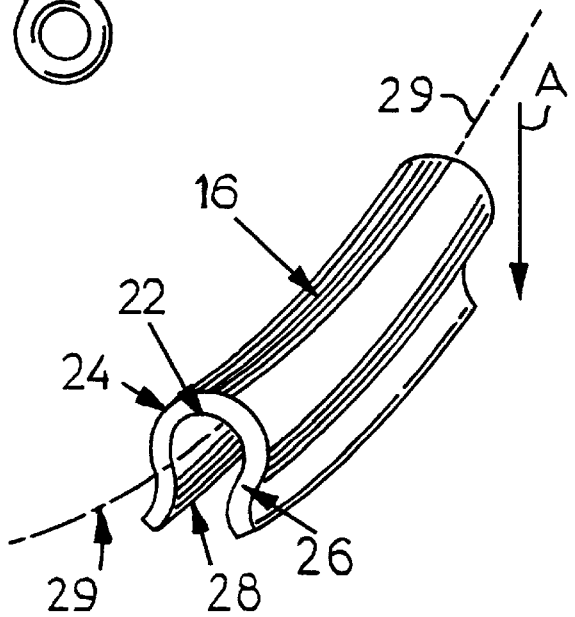
FIG. 2 is an end perspective view of a clip for the frame of the bag holder shown in FIG. 1 and enlarged for illustration purposes.

The operation of the hand held bag holder will now be described. Initially, an upper portion of a bag is fed through mouth 18 of the ring and folded over the ring. An elongate clip 16 is then located over one of said six sections and forced downwards ie. in a direction perpendicular to a plane in which said ring lies in and in the direction indicated by arrow 'A', over the section such that legs 24,26 straddle the ring. Hence, the installation of the clip is in a direction which is perpendicular to the plane in which said longitudinal axis 29 lies in. As the clip moves downwards, the free ends thereof are forced outwards by their contact with the ring and the legs flex sufficiently to enable the clip to fit around the circular section. In view of the fact that the diameter of the cylindrical hollow defined by the clip is substantially equal to that of the section, the legs will exert a clamping force on the portion of the bag overlapping said section ie leg 24 exerts a radially inward clamping force and leg 26 exerts a radially outward clamping force. With the clip in the position shown in FIG. 3, the free ends of the clip are allowed to relax and return to their usual position thereby providing a snap-fit engagement with the ring. As can be seen with reference to FIG. 3, the clip envelops a substantial portion of the circumference of a cross section ie. at least 50% thereof. In this position, the free ends must be forced apart in order to enable the clip to be removed and hence ensures that it is not inadvertently removed during use. As described above, the free ends are directed outwardly thus providing finger purchase thereby facilitating the removal of the clip from the ring. In the illustrated embodiment, the clip is positioned with its legs 24,26 extending in a direction which is perpendicular to handle 14. Although that is the preferred positioning of a clip, in an alternative arrangement (not illustrated) a clip is provided for locating onto the ring in a direction such that its legs extend radially inward or outward from the ring. In this alternative arrangement, the clip has a curved longitudinal axis which lies in a single plane and the clip is installed on the ring in a direction which is substantially parallel to said plane.

By locating the six clips in the manner described above, the upper portion of the bag is secured to the ring with the mouth in an open position. In practice, it may not be necessary to utilise all six clips to secure a bag and, for example, only four may be required.

It is envisaged that different sizes of ring will be provided to match varying sizes of bags.

In a further embodiment of the invention (not illustrated), the bag holder is secured to a wall by a bracket or by any other convenient means and used in this static manner.

We claim:

1. A hand held bag holder (10) comprising a member (12) forming a frame defining a mouth (18) and a plurality of clips (16) wherein the clips each have two or more spaced locating limbs (24, 26) which, in use, at least partially envelop the circumference of a cross section of the member for securing an open end of a bag to the frame such that a mouth of the bag is supported in an open position, wherein, in use, the clips secure the bag to the frame, and wherein the frame has predefined spaced apart locations (20) of reduced diameter at which locations said clips cooperate with the frame.

2. A bag holder (10) as claimed in claim 1 wherein, in use, an upper part of the bag is folded over a top side of the frame (12) and the clips (16) are installed such that a portion of the bag is held, clamped or gripped, at least partially around said circumference.

3. A bag holder (10) as claimed in claim 1 wherein the clips (16) each have a base (22), and the two spaced locating limbs (24, 26) are in the form of legs, said legs extending away from said base and defining an open mouth (28) therebetween.

4. A bag holder (10) as claimed in claim 1 wherein the clips (16) are each defined by a generally U-shaped channel.

5. A bag holder (10) as claimed in claim 1 wherein, in use, the limbs (24, 26) substantially envelope the circumference of the cross section of the member (12) thereby clamping a portion of the bag around a substantial portion of said circumference.

6. A bag holder (10) as claimed in claim 1 wherein the frame (12) is annular and the mouth (18) defined thereby is circular.

7. A bag holder (10) as claimed in claim 1 wherein the clips (16) are installed on said frame member (12) in a direction which is in the plane of said frame or in a plane parallel thereto.

8. A bag holder (10) as claimed in claim 7 wherein the clips (16) are installed in an inwardly directed radial direction.

9. A bag holder (10) as claimed in claim 1 wherein the direction of installation of the clips (16) is substantially perpendicular to the plane of said frame (12) and in a direction from a top side of the frame to an opposing side.

10. A bag holder (10) as claimed in claim 1 wherein the clips (16) are configured for snap fit engagement with the frame (12).

11. A bag holder comprising a member forming a frame defining a mouth and a plurality of clips which, in use, at least partially envelop the circumference of a cross section of the member for securing an open end of a bag to the frame such that a mouth of the bag is supported in an open position wherein, in use, the clips secure the bag to the frame, and wherein the frame has predefined spaced apart locations of reduced diameter at which locations said clips cooperate with the frame.

* * * * *